US008186319B2

(12) United States Patent
Pluta et al.

(10) Patent No.: US 8,186,319 B2
(45) Date of Patent: May 29, 2012

(54) CONCENTRIC CAM WITH CHECK VALVES IN THE SPOOL FOR A PHASER

(75) Inventors: Christopher J. Pluta, Ithaca, NY (US); Mark M. Wigsten, Lansing, NY (US); Steven W. Wyatt, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 413 days.

(21) Appl. No.: 12/663,924

(22) PCT Filed: Jun. 13, 2008

(86) PCT No.: PCT/US2008/066862

§ 371 (c)(1),
(2), (4) Date: Dec. 10, 2009

(87) PCT Pub. No.: WO2009/005999

PCT Pub. Date: Jan. 8, 2009

(65) Prior Publication Data

US 2010/0170458 A1 Jul. 8, 2010

Related U.S. Application Data

(60) Provisional application No. 60/947,470, filed on Jul. 2, 2007, provisional application No. 61/041,663, filed on Apr. 2, 2008.

(51) Int. Cl.
*F01L 1/34* (2006.01)

(52) U.S. Cl. ..... 123/90.17; 123/90.15; 123/90.31

(58) Field of Classification Search ..... 123/90.15, 123/90, 17, 90.31

See application file for complete search history.

(56) References Cited

U.S. PATENT DOCUMENTS

| | | | |
|---|---|---|---|
| 1,527,456 | A | 2/1925 | Woydt et al. |
| 1,953,547 | A | 4/1934 | Wolff |
| 3,424,319 | A | 1/1969 | Hohlfelder |
| 3,523,465 | A | 8/1970 | Harrell |

(Continued)

FOREIGN PATENT DOCUMENTS

| | | |
|---|---|---|
| DE | 3212663 | 10/1983 |

(Continued)

OTHER PUBLICATIONS

Automotive Handbook, Bosch "Electrohydraulic Pumps and Small Units", pp. 634-637.

(Continued)

*Primary Examiner* — Zelalem Eshete
(74) *Attorney, Agent, or Firm* — Brown & Michaels, PC

(57) ABSTRACT

A camshaft assembly for an internal combustion engine has a hollow outer shaft with slots along its length and an inner shaft with holes along its length. The holes on the inner shaft are aligned with the slots on the outer shaft. A first set of cam lobes are fixed to the outer shaft and a second set of cam lobes are placed on the slots of outer shaft with a clearance fit. A means fixes the second set of cam lobes to the inner shaft, while simultaneously allowing the second set of cam lobes to be a clearance fit to the outer shaft. The means fixing the second set of cam lobes to the inner shaft may be a hollow pin which is hydroformed or a rivet insert which is expanded by insertion, pulling, and removal of a threaded rod.

18 Claims, 12 Drawing Sheets

U.S. PATENT DOCUMENTS

| | | | |
|---|---|---|---|
| 3,528,328 | A | 9/1970 | Jeanneret |
| 3,619,898 | A | 11/1971 | Perry et al. |
| 3,975,817 | A | 8/1976 | Frazier |
| 4,607,764 | A | 8/1986 | Christine |
| 5,002,023 | A | 3/1991 | Butterfield et al. |
| 5,107,804 | A | 4/1992 | Becker et al. |
| 5,165,303 | A | 11/1992 | Riemscheid et al. |
| 5,172,659 | A | 12/1992 | Butterfield |
| 5,207,192 | A | 5/1993 | Smith |
| 5,218,935 | A | 6/1993 | Quinn, Jr. et al. |
| 5,235,939 | A | 8/1993 | Levin et al. |
| 5,289,805 | A | 3/1994 | Quinn, Jr. et al. |
| 5,291,860 | A | 3/1994 | Quinn, Jr. |
| 5,361,735 | A | 11/1994 | Butterfield et al. |
| 5,386,807 | A | 2/1995 | Linder |
| 5,402,759 | A | 4/1995 | Ding et al. |
| 5,417,186 | A | 5/1995 | Elrod et al. |
| 5,417,241 | A | 5/1995 | Tischer et al. |
| 5,497,738 | A | 3/1996 | Siemon et al. |
| 5,577,420 | A | 11/1996 | Riemscheid et al. |
| 5,657,725 | A | 8/1997 | Butterfield et al. |
| 5,664,463 | A | 9/1997 | Amborn et al. |
| 5,666,914 | A | 9/1997 | Ushida et al. |
| 5,884,592 | A | 3/1999 | Korostenski et al. |
| 6,725,817 | B2 | 4/2004 | Methley et al. |
| 6,725,818 | B2 | 4/2004 | Methley |
| 6,745,732 | B2 | 6/2004 | Ekdahl et al. |
| 6,763,791 | B2 | 7/2004 | Gardner et al. |
| 6,814,038 | B2 | 11/2004 | Smith |
| 6,832,586 | B2 | 12/2004 | Williams |
| 6,854,435 | B2 | 2/2005 | Williams |
| 6,883,481 | B2 | 4/2005 | Gardner et al. |
| 6,899,126 | B2 | 5/2005 | Weigand et al. |
| 6,941,913 | B2 | 9/2005 | Smith |
| 7,000,580 | B1 | 2/2006 | Smith et al. |
| 7,069,892 | B2 | 7/2006 | Lechner et al. |
| 7,159,549 | B2 | 1/2007 | Tsukada et al. |
| 7,444,968 | B2 * | 11/2008 | Lancefield et al. ..... 123/90.17 |
| 2005/0279302 | A1 | 12/2005 | Lancefield et al. |
| 2006/0086332 | A1 | 4/2006 | Simpson et al. |
| 2006/0157008 | A1 | 7/2006 | Lechner |
| 2006/0185471 | A1 | 8/2006 | Lawrence et al. |
| 2006/0207529 | A1 | 9/2006 | Lawrence et al. |
| 2006/0207538 | A1 | 9/2006 | Lancefield et al. |

FOREIGN PATENT DOCUMENTS

| | | | |
|---|---|---|---|
| DE | 3933923 | | 4/1991 |
| DE | 3934848 | | 4/1991 |
| DE | 3943426 | | 4/1991 |
| DE | 4416505 | | 11/1995 |
| DE | 1975704 | A1 | 7/1997 |
| EP | 0254058 | | 1/1988 |
| EP | 1447602 | | 8/2004 |
| EP | 1614867 | | 1/2006 |
| GB | 1090500 | | 11/1967 |
| GB | 2327482 | | 1/1999 |
| GB | 2431977 | A | 5/2007 |
| JP | 01205828 | | 8/1989 |
| JP | 03111607 | | 5/1991 |
| JP | 07167152 | | 7/1995 |
| JP | 2004108370 | | 4/2004 |
| WO | 2006000832 | | 1/2006 |
| WO | 2006050686 | | 5/2006 |
| WO | 2006067519 | | 6/2006 |
| WO | 2006081788 | | 8/2006 |
| WO | 2006097767 | | 9/2006 |

OTHER PUBLICATIONS

European Search Report for EP Patent Application No. 08770966.3; Jan. 30, 2012; 8 pages.

* cited by examiner

CONCENTRIC CAM WITH CHECK VALVES IN THE SPOOL FOR A PHASER

REFERENCE TO RELATED APPLICATIONS

This application claims one or more inventions which were disclosed in Provisional Application No. 60/947,470, filed Jul. 2, 2007, entitled "CONCENTRIC CAM WITH CHECK VALVES IN THE SPOOL FOR A PHASER" and Provisional Application No. 61/041,663 filed Apr. 2, 2008, entitled "CONCENTRIC CAM WITH CHECK VALVES IN THE SPOOL FOR A PHASER". The benefit under 35 USC §119 (e) of the United States provisional application is hereby claimed, and the aforementioned application is hereby incorporated herein by reference.

BACKGROUND OF THE INVENTION

1. Field of the Invention

The invention pertains to the field of concentric camshafts. More particularly, the invention pertains to a concentric cam with check valves in the spool for a cam torque actuated phaser.

2. Description of Related Art

Cam in cam systems are well know in the prior art. In prior art cam in cam systems, the camshaft has two shafts, one positioned inside of the other. The shafts are supported one inside of the other and are rotatable relative to one another for a limited axial distance.

U.S. Pat. Nos. 5,165,303 and 5,577,420 disclose a cam in cam system in which the inner cams are contained on the inner shaft and cam lobes extend through the inner and outer shafts through slots. The outer shaft provides a base circle cam surface for the lobes of the cams connected to the inner shaft.

Unlike in prior art U.S. Pat. No. '303 and U.S. Pat. No. '420, both sets of cams are movable about or fixed to the outer shaft, not the inner shaft, the lobes of the first set of cams do not extend though slots of the second shaft, and the second shaft does not have a means for providing base circle cam surfaces for the lobe portions of the first set of cams.

U.S. Pat. No. 5,664,463 discloses a system in which an outer shaft includes individual longitudinal portions which are connected to one another. The inner cams are connected to the inner shaft by a first form fitting means and the outer cams are connected to the other shaft by a second form fitting means. The inner cams form slots which cover a sector of a circle and are penetrated by axial finger portions of the outer shaft.

The present invention does not have an outer shaft with individual longitudinal portions or axial finger portions, nor do the inner cams form slots.

U.S. Pat. No. 6,725,817 discloses a camshaft assembly that includes an inner shaft surrounded by an outer sleeve or tube which can rotate relative to the inner shaft through a limited angle. One set of cams is directly connected to the outer tube. A second set of cams is freely journalled on the outer tube and is connected to the inner shaft by pins which pass through tangentially elongated slots in the outer tube. The end of the inner shaft projects at the front end of the engine and carries the drive sprocket, which incorporates a variable phase drive sprocket.

The drive mechanism of the variable phase drive sprocket includes a drive member connectable for rotation with the engine crankshaft and two driven members each connectable for rotation with respective sets of the cams. Each of the driven members is connected by a vane-type hydraulic coupling for rotation with the drive member. The hydraulic coupling is such that the angular position of each of the driven members may be varied relative to the drive member, independent of the other drive member. In other words, a cam-in cam system with a dual phaser.

The present invention only has one driven member coupled for rotation with the drive member by means of vane-type hydraulic coupling and one driven member is fixed. The driven members cannot be adjusted independently of one another.

U.S. Pat. No. 6,725,818 discloses a camshaft comprises an inner drive shaft journalled within an outer tube. Cams are directly mounted on the outer tube for rotation therewith and other cams are freely rotatable around the outer tube and connected for rotation to the inner drive shaft by a hollow pin that passes through a hole in the outer tube.

In a first embodiment, the connecting pin is formed with two different diameters, with the central portion of the pin having a diameter less than the diameter of the two ends.

In a second embodiment, a tapered thread or an interference fit thread is provided on an element that is screwed into the bore of the connecting pin to fix the pin in position in the inner drive shaft.

In a third embodiment, one or more spherical elements are pushed into the bore of the connecting pin to expand it into the bore in the inner drive shaft.

In a fourth embodiment, the connecting pin has a mandrel forced through it, which is sized such that the central portion of the connecting pin is expanded beyond its elastic limit and therefore remains an interference fit in the inner drive shaft after the mandrel has been removed.

In the present invention, the connecting pin is dimensioned to be a clearance fit, not a close fit. The pin of the present invention, unlike prior art U.S. Pat. No. '818 has a constant inner diameter, a small diameter region is not present. Plus, the present invention does not insert an element of a larger diameter into the pin to expand the pin.

In U.S. Published Application No. 2005/0279302, a vane-type phaser driven by a crankshaft drives the inner shaft and the outer tube of a first single cam phaser camshaft which is coupled for rotation with the inner shaft and the outer tube of a second single cam phaser camshaft by drive links. The drive links are meshing gearwheels. The phaser may alter both the inner shafts and outer tubes of both camshafts or individual single vane-type phasers may each transmit torque to the first and second camshafts.

The first and second camshafts each have cams formed directly on the two inner shafts and other cams formed on the two outer tubes. Cams that rotate with the outer tubes have collars coupled to the outer tube by heat shrinking and cams that rotate with the inner shaft are loose fit on the outer tube and are connected to the inner shaft by pins that pass through the circumferentially elongated slots in the outer tube.

The present invention does not use drive links to ensure that each group of cam lobes on the first camshaft rotates in unison and drives a second camshaft with a corresponding group of cam lobes on a second camshaft.

U.S. Published Application No. 2006/0185471 discloses a camshaft including an inner shaft and an outer tube surrounding and rotatable relative to the inner shaft. Two groups of cam lobes are mounted on the outer shaft, with one group fast in rotation to the outer tube and the other group rotatably mounted to the outer tube and connected for rotation with the inner shaft by pins that pass with clearance through slots in the outer tube. A sleeve rotatably mounted on the outer tube is connected to impart drive to the inner shaft by a pin passing with clearance through a circumferentially extending slot in the outer tube.

In the present invention, a sleeve is not rotatably mounted on the outer sleeve at all and therefore cannot be connected to the inner shaft to impart drive to the inner shaft.

U.S. Published Application No. 2006/0207538 discloses a camshaft formed of an inner shaft and an outer tube, both of which rotate with respective groups of cams. A drive train driving the inner shaft and outer tube includes a phaser for varying at least one group of cams relative to the phase of the crankshaft. The phaser is secured to the front end of the outer tube and the inner shaft is connected to the front side of the phaser by a driving member.

The phaser in the present invention is not mounted to the front end of the camshaft by a component arranged on the front side of the phaser. The present invention also does not contain a driving member overlying the component axially retaining the phaser on the outer tube and coupling the front side of the phaser for rotation with the inner shaft of the camshaft.

WO 2006/000832 discloses a phaser shifts the phase of the camshaft relative to the engine crankshaft. The phaser may be hydraulically operated or may rely on the reversal of reaction torque of the valve train. The camshaft has an outer tube journalled in bearings in the cylinder head, acting as a phased rotary member and carries of the all of the cams which are phased. The outer tube supports an inner shaft corresponding to an unphased rotary member, serving to transmit torque to an auxiliary device.

In alternative embodiment, the camshaft includes a journalled outer tube supporting an inner shaft. Only some of the cams are mounted on the outer tube and rotate with it. The remaining cams rotate about the outer tube and are coupled for rotation with the inner shaft by pins that pass through tangentially elongated slots in the outer tube. To avoid the pins passing through the cam lobes, each of the cams that rotate with the inner shaft is formed with an annular extension which receives the pin.

In both embodiments, the phaser is used to drive the phased member or outer tube of the camshaft.

In the present invention, an auxiliary device is not connected to be driven by torque transmitted from the crankshaft through the first rotary member of the camshaft or the inner shaft and is not even present at all.

WO 2006/067519 discloses a phaser with a drive member and a driven member. The drive member comprises a disc with at least one arcuate cavity that is open at both axial ends. The driven member comprises two closure plates sealing off the arcuate cavities at the axial ends and at least one vane formed separately from the closure plates. The vane is moveably received within the cavity and divides the cavity into two chambers. Each vane is secured at both its axial ends by the closure plates.

The phaser is fitted to a camshaft assembly comprised of an inner shaft and an outer shaft. The outer shaft has a threaded end engageable with an internal screw thread formed in the disc. The inner shaft has an internal thread that is engaged by the thread of a bolt that passes through an axial pre in the closure plate and acts to clamp the closure plate against the axial end of the inner shaft. The outer shaft rotates with the driven member or the disc and the inner shaft rotates with the drive member or the closure plates. Different groups of cams are fast in o rotation with each of the shafts. The phaser will alter the phase of some of the cams relative to the crankshaft, while other cams are always rotated in the same phase relative to the crankshaft.

In the present invention, the vanes are not secured at both axial ends to two closure plates or ends plates, they are formed integrally with the rotor, as is conventional with vane phasers.

WO 2006/97767 discloses a camshaft assembly comprised of an inner shaft and an outer tube surrounding and rotatable relative to the inner shaft. Two groups of cam lobes are mounted on the outer shaft, with one group fast in rotation to the outer tube and the other group rotatably mounted to the outer tube and connected for rotation with the inner shaft. The connection between the cam lobes and the inner shaft is effected by driving members whose positions are adjustable in order to compensate for significant manufacturing inaccuracies between the inner shaft and its associated group of cam lobes.

In the present invention, the driving members connecting the inner shaft to the cams are not adjustably to compensate for significant manufacturing inaccuracies between the inner shaft and its associated group of cam lobes.

U.S. Published Application No. 2006/0207529 discloses a camshaft assembly including an inner shaft and an outer tube surrounding and rotatable relative to the inner shaft. Two groups of cam lobes are mounted on the outer shaft, with one group fast in rotation to the outer tube and the other group rotatably mounted to the outer tube and connected for rotation with the inner shaft by pins that pass with clearance through slots in the outer tube. A spring is incorporated into the camshaft assembly to bias the inner shaft relative to the outer tube towards one extreme of its angular range. A phaser is mounted to the camshaft assembly by a conventional flange and bolt arrangement.

In the present invention, the inner tube of the camshaft assembly runs entirely through the phaser, to act as a sleeve for the spool control valve, and the outer tube fastens to an extension of the sprocket. The present invention does not attach the phaser to the camshaft assembly using a conventional flange and bolt arrangement.

DE 39 43 426 discloses a camshaft with two shaft elements one inside of the other, either of which can be moved with respect to each other. First cam elements are connected to the inner shaft and second cam elements are connected to the outer shaft. The outer shaft has apertures which received pins that connect the first cam elements with the inner shaft. The cams are fastened by pins on both sides of the cam, not just on one side (i.e. through one hole).

In the present invention, the pins do pass entirely through the inner shaft and the slots in the outer tube, through two slots penetrating the outer tube.

SUMMARY OF THE INVENTION

A camshaft assembly for an internal combustion engine has a hollow outer shaft with slots along its length and an inner shaft with holes along its length. The holes on the inner shaft are aligned with the slots on the outer shaft. A first set of cam lobes are fixed to the outer shaft and a second set of cam lobes are placed on the slots of outer shaft with a clearance fit. A means fixes the second set of cam lobes to the inner shaft, while simultaneously allowing the second set of cam lobes to be a clearance fit to the outer shaft. The means fixing the second set of cam lobes to the inner shaft may be a hollow pin which is hydroformed or a rivet insert which is expanded by insertion, pulling, and removal of a threaded rod.

The camshaft assembly is attached to a phaser. The phaser includes a housing, a rotor, a control valve and an actuator. The housing has an outer circumference for accepting drive force. The rotor is coaxially located within the housing and fixedly attached to an end of the inner shaft of the camshaft assembly. The housing and the rotor define at least one vane separating a chamber in the housing. The vane is capable of rotation to shift the relative angular position of the housing and the rotor.

A bore at the end of the inner shaft includes a sleeve for slidably receiving a spool with a plurality of lands of the control valve. The spool directs fluid to the chambers of the phaser. The sleeve at the end of the bore has annuluses in alignment with ports on the spool. The vane is capable of rotation to shift the relative angular position of the housing and the rotor.

A method of assembling the camshaft assembly fixed to phaser is also disclosed.

DETAILED DESCRIPTION OF THE INVENTION

Figure 1:
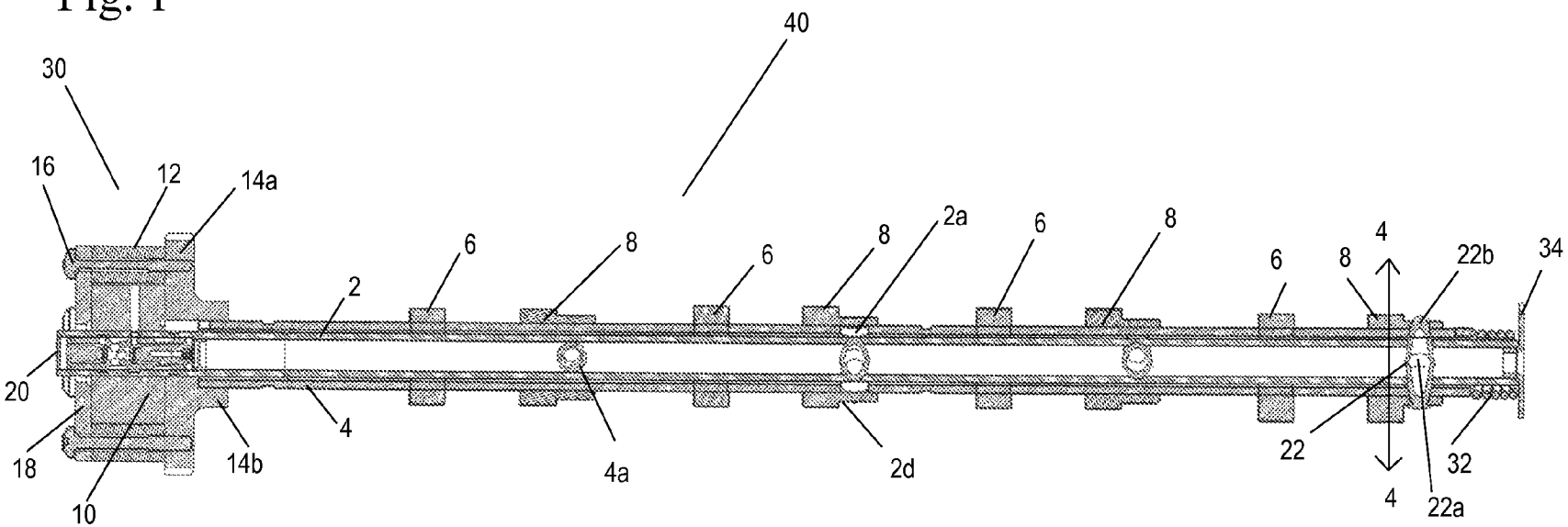
FIG. 1 shows a schematic of the cam in cam system with a phaser.

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor with one or more vanes, mounted to the end of the camshaft assembly, surrounded by a housing with the vane chambers into which the vanes fit (not shown). It is possible to have the vanes mounted to the housing, and the chambers in the rotor, as well. A portion of the housing's outer circumference forms the sprocket, pulley or gear accepting drive force through a chain, belt, or gears, usually from the crankshaft, or possible from another camshaft in a multiple-cam engine. FIG. 1 shows a camshaft assembly 40 attached to a phaser of the present invention.

The camshaft assembly 40 has an inner shaft 4 and an outer shaft 2. The outer shaft 2 is hollow with multiple slots 2*a* that run perpendicular to the axis of rotation and has a sprocket 14*a* attached to the outside of the outer shaft 2. The sprocket 14*a* is overhung off of the end of the outer shaft 2 creating the only bearing 14*b* and prevents the inner and outer shafts 4, 2 from hitting each other. The inner and outer shafts 4, 2 are not machined to make contact with each other. Inside the hollow outer shaft 2 is a hollow inner shaft 4 with multiple holes 4*a* that run perpendicular to the length of the shaft. At one end, the rotor 10 of the phaser 30 is rigidly attached to the inner shaft 4. The inner shaft 4 is positioned within the outer shaft 2 such that the holes 4*a* of the inner shaft 4 are aligned with the slots 2*a* in the outer shaft 2.

A first set of cam lobes 6 are rigidly attached to the outer shaft 2 and a second set of cam lobes 8 are free to rotate and placed on the outer shaft 2 with a clearance fit. The second set of cam lobes 8 are positioned over the slots 2*a* on the outer shaft 2 and are controlled by the inner shaft 4 through a mechanical connection.

Figure 2:
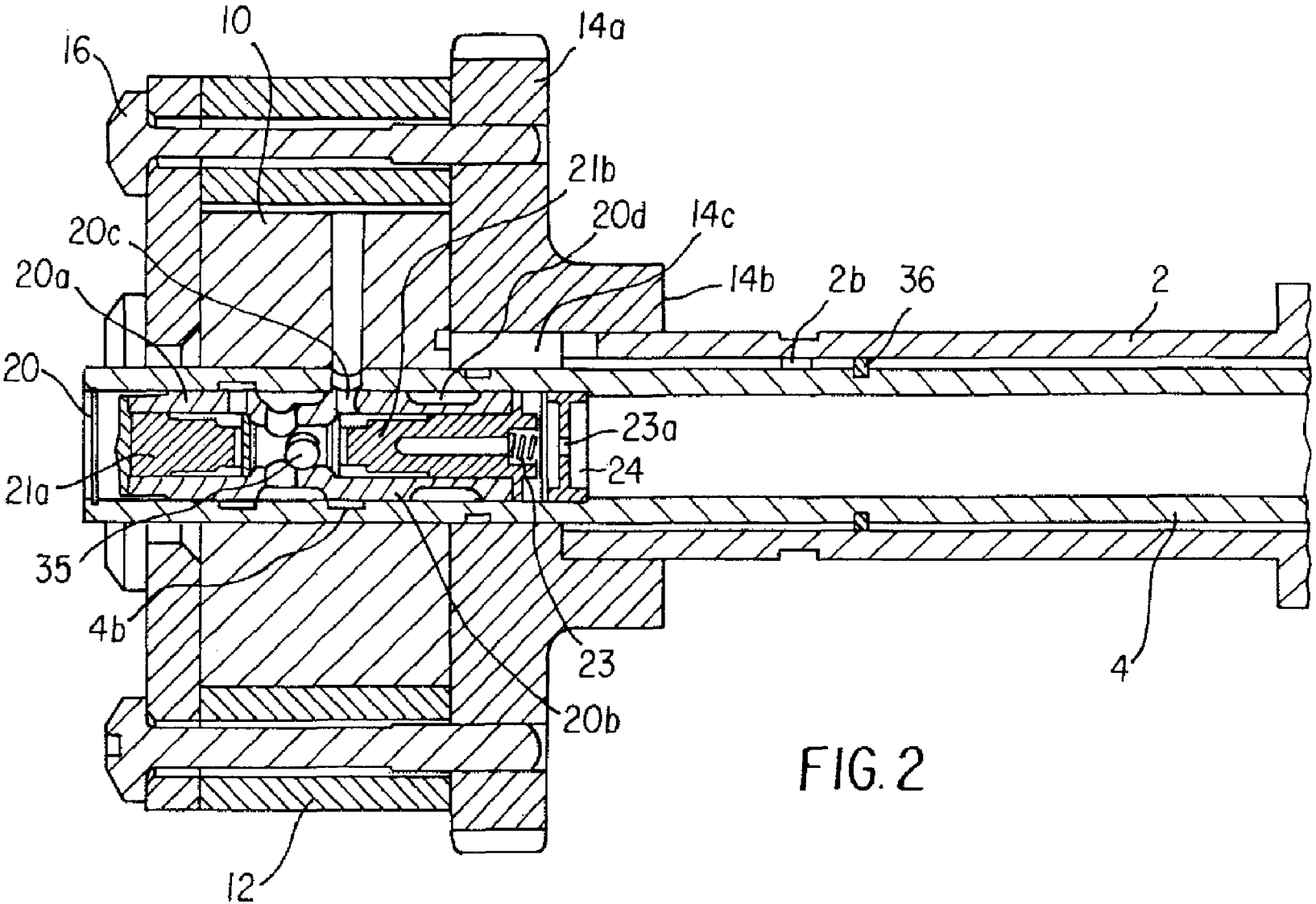
FIG. 2 shows a magnified view of the phaser attached to the concentric camshaft.
Figure 3:
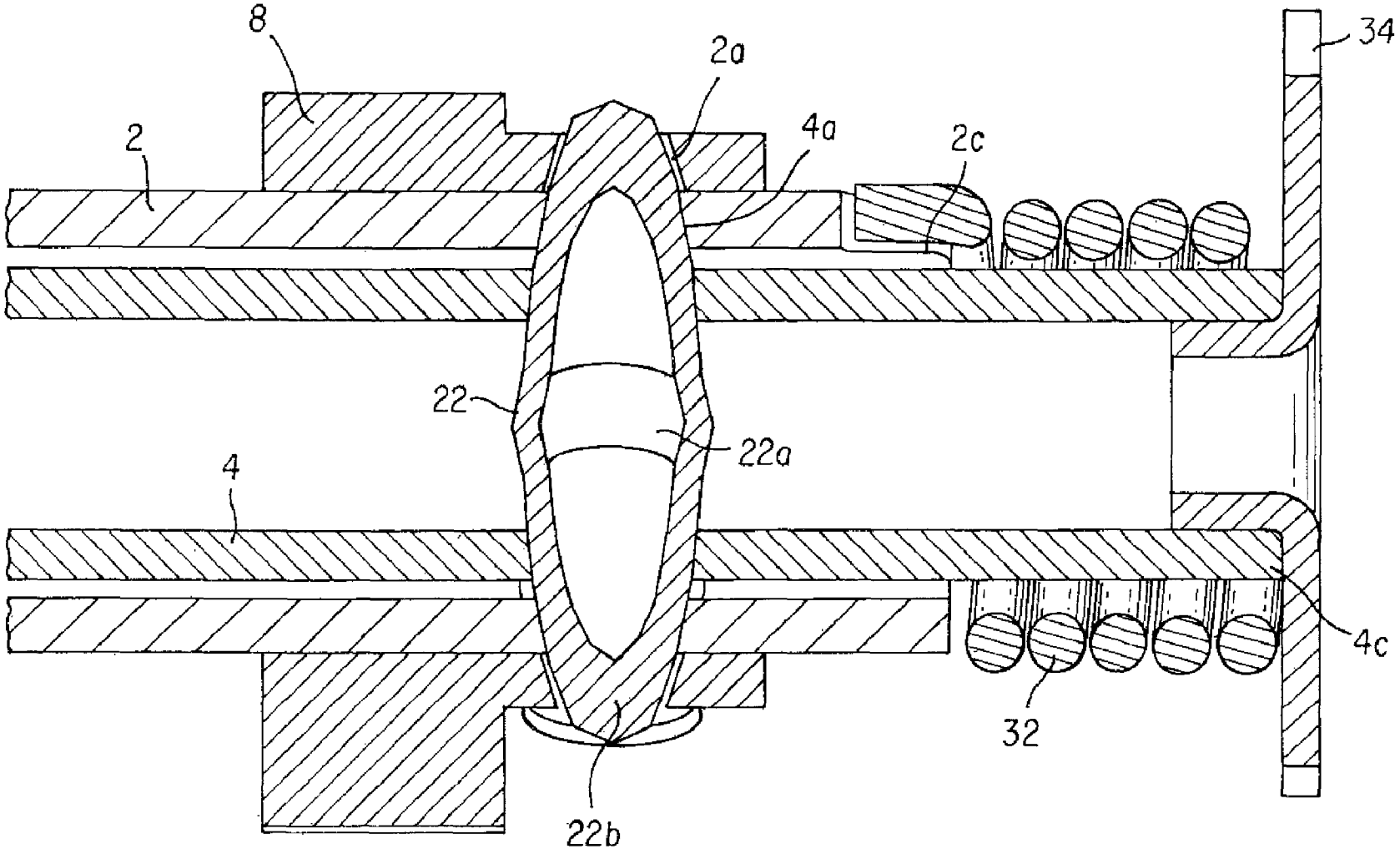
FIG. 3 shows a magnified view of the end of the concentric camshaft, opposite the phaser.
Figure 4:
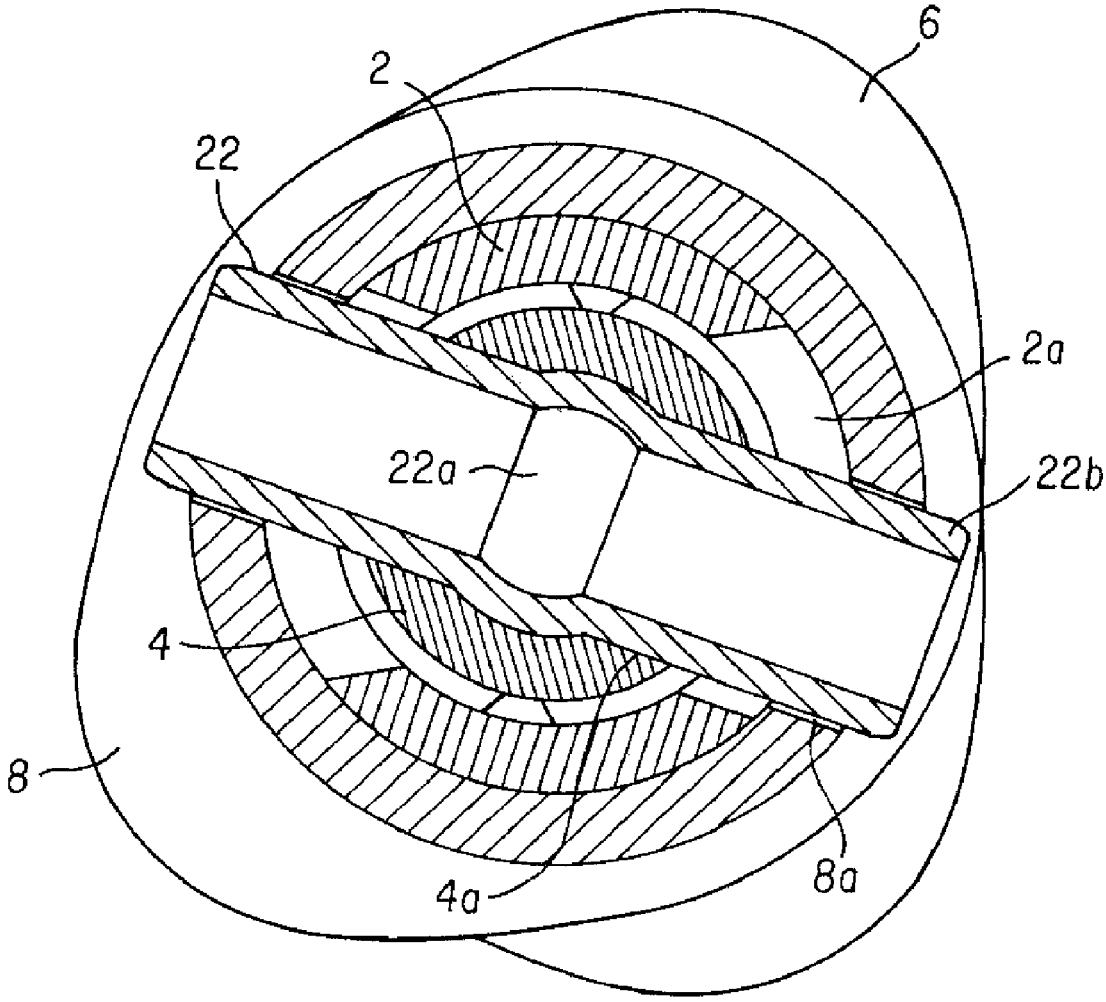
FIG. 4 shows a sectional view along line 4-4 of FIG. 1.

In a first embodiment, hollow pins 22 are the mechanical connection and they are used to hold the slip-fit cam lobes or the second set of cams 8 in place on the outer shaft 2 while creating the connection with the inner shaft 4. During initial assembly, the pin 22 is a clearance fit to the cam lobe 8, inner shaft 4 and outer shaft 2. The pin 22 is slid through a hole 8*a* on the cam lobe flange and then passed through the slot 2*a* on the outer shaft 2 and the hole 4*a* in the inner shaft 4, continuing through the axis of rotation to the outer side of the cam lobe. Once the pin 22 is in position, a plug is inserted on one end of the pin and the center 22*a* of the pin is hydroformed, where fluid under pressure is sent to the center of the pin from the other side of the pin, swelling the center 22*a* of the pin within the inner shaft 4. It should be noted that the pressure should be limited to allow the center of the pin to expand only and not cause the pin to burst. The portion 22*c* of the pin 22 that extends beyond the inner shaft 4 through the cam lobe 8 is not deformed, so the pin 22 maintains its clearance fit to the outer shaft 2 and moveable cam lobe. The plug and the means for inserting fluid into the center of the pin are then removed. The clearance fit cam lobes or second cam lobes 8 will float or slide back and forth axially on the pin 22 as shown in FIGS. 2 and 3. Alternatively, a shrink fitted pin may also be used in place of the hydroforming process with a hollow pin.

Due to manufacturing tolerances, the clearance fit cam lobes or second cam lobes 8 need to be able to float or slide back forth axially on the pin 22. If the lobe 8 is rigidly fixed to the pin 22, unable to float, there could be potential for binding issues to the outer shaft 2, making them rigidly attached to the outer shaft 2. The stationary lobes or first set of cams 6 are shrink-fit to the outer shaft 2 using methods such as welding. By having all of the cam lobes 6, 8 ride or attached to the outer shaft 2 helps reduce issues with runout between the shafts and lobes. If the movable cam lobes rested on the inner shaft the runout between the two shafts 2, 4 would become critical.

Figure 5:
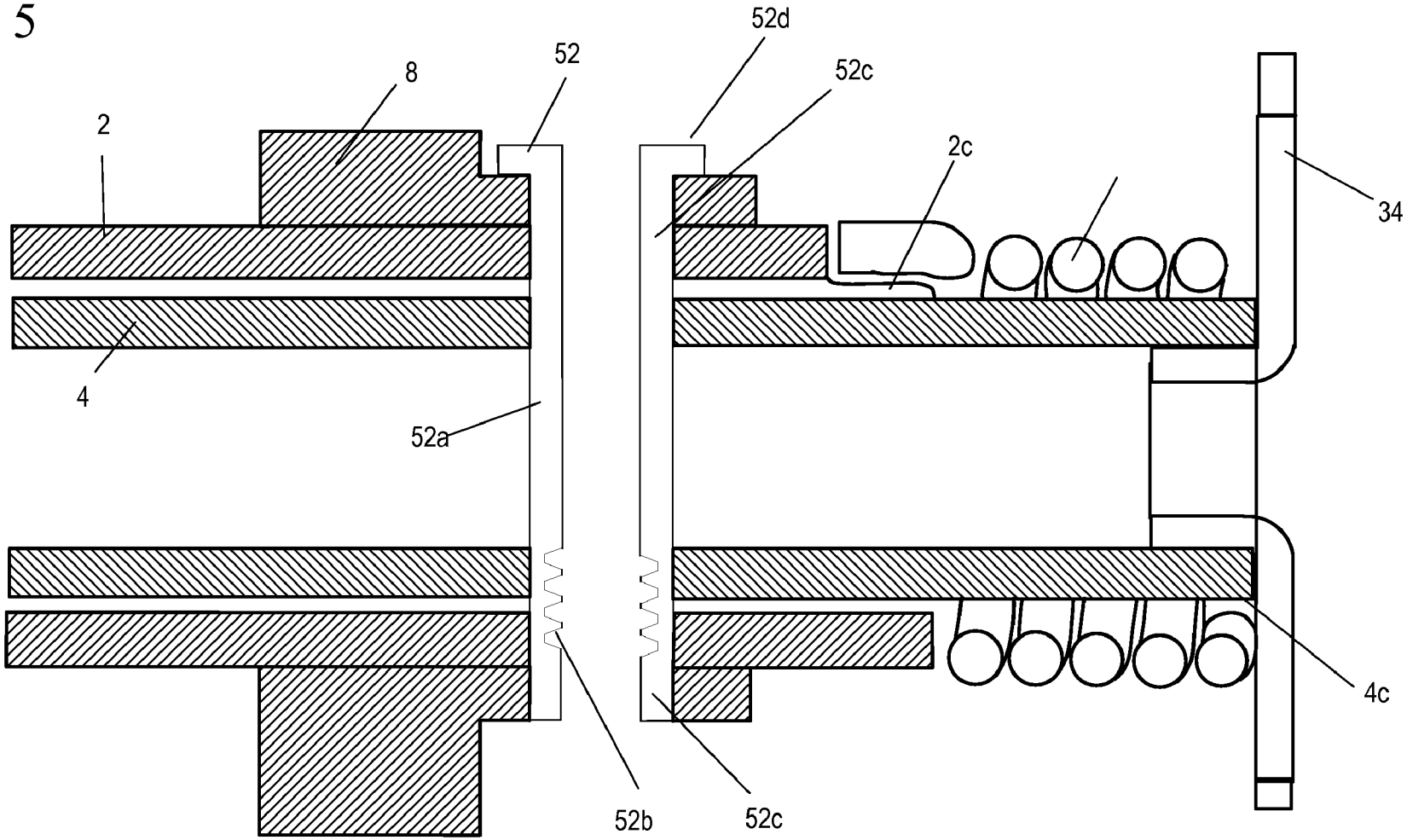
FIG. 5 shows a magnified view of the end of the concentric camshaft with a mechanical connection between the inner shaft and the outer shaft of a second embodiment prior to securing the mechanical connection to the inner shaft of the concentric camshaft.
Figure 6:
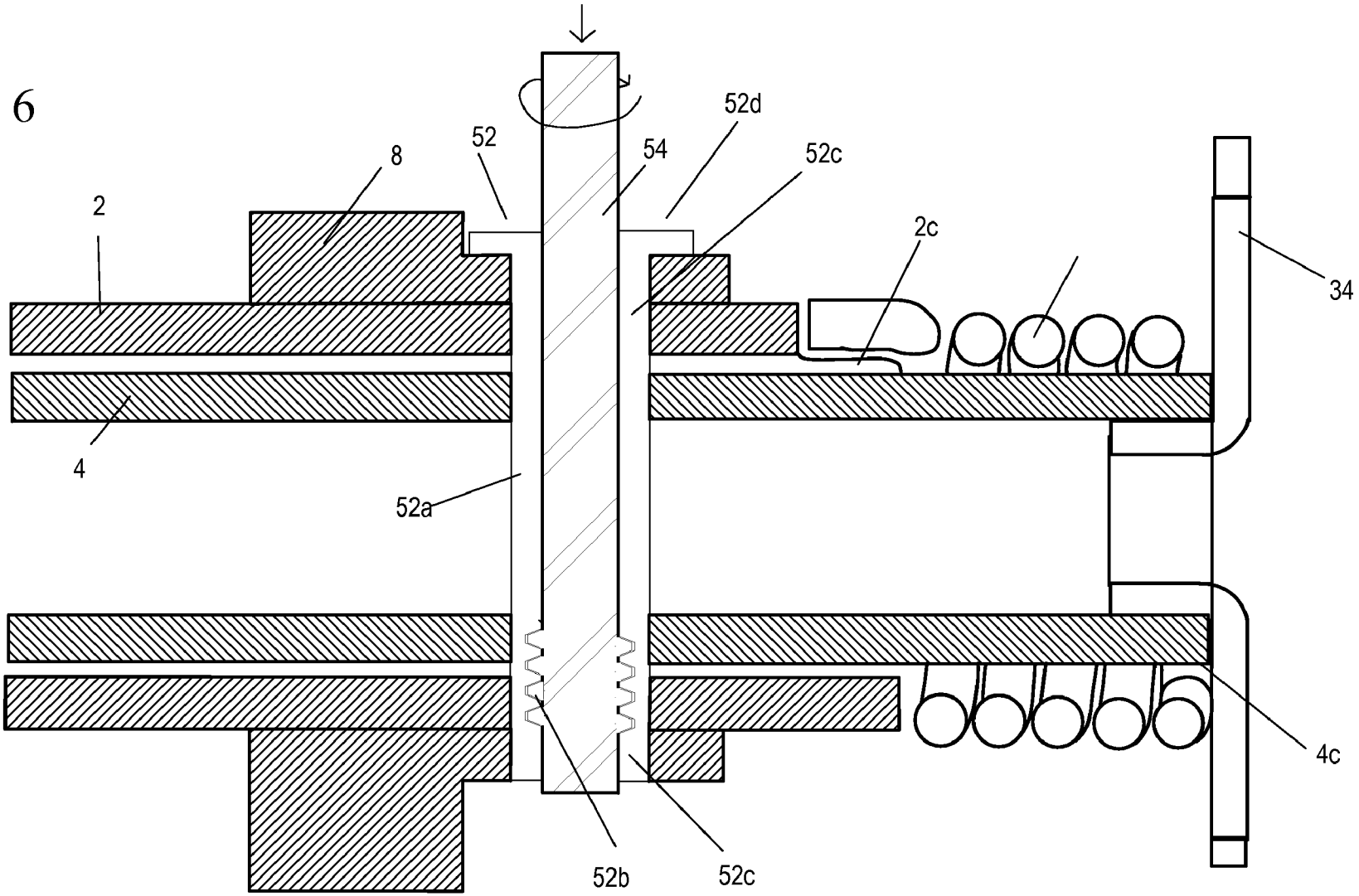
FIG. 6 shows a magnified view of the end of the concentric camshaft with a mechanical connection between the inner shaft and the outer shaft with a rod of the second embodiment prior to securing the mechanical connection to the inner shaft of the concentric camshaft.
Figure 7:
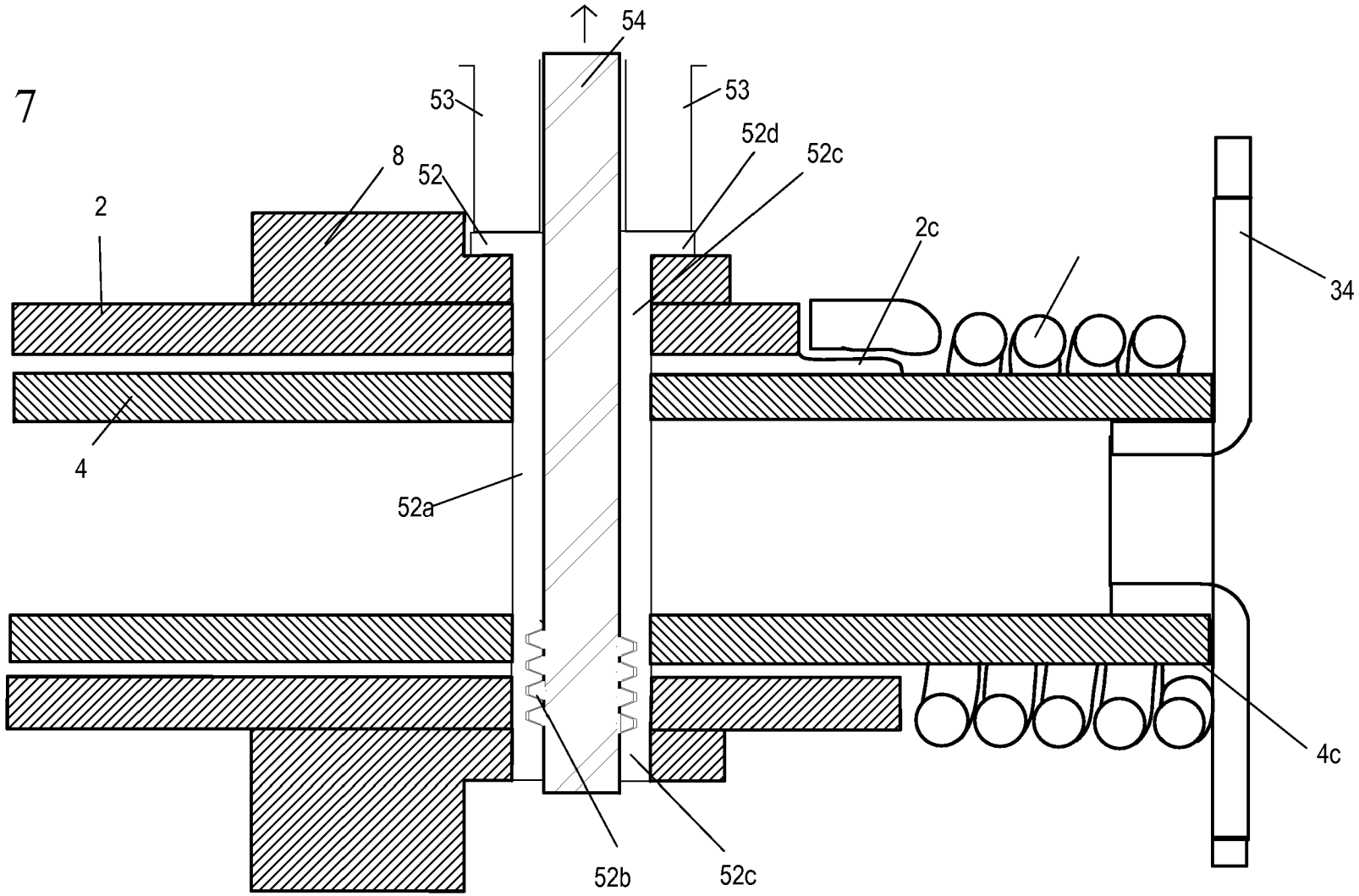
FIG. 7 shows a magnified view of the end of concentric camshaft prior to unthreading the rod.
Figure 8:
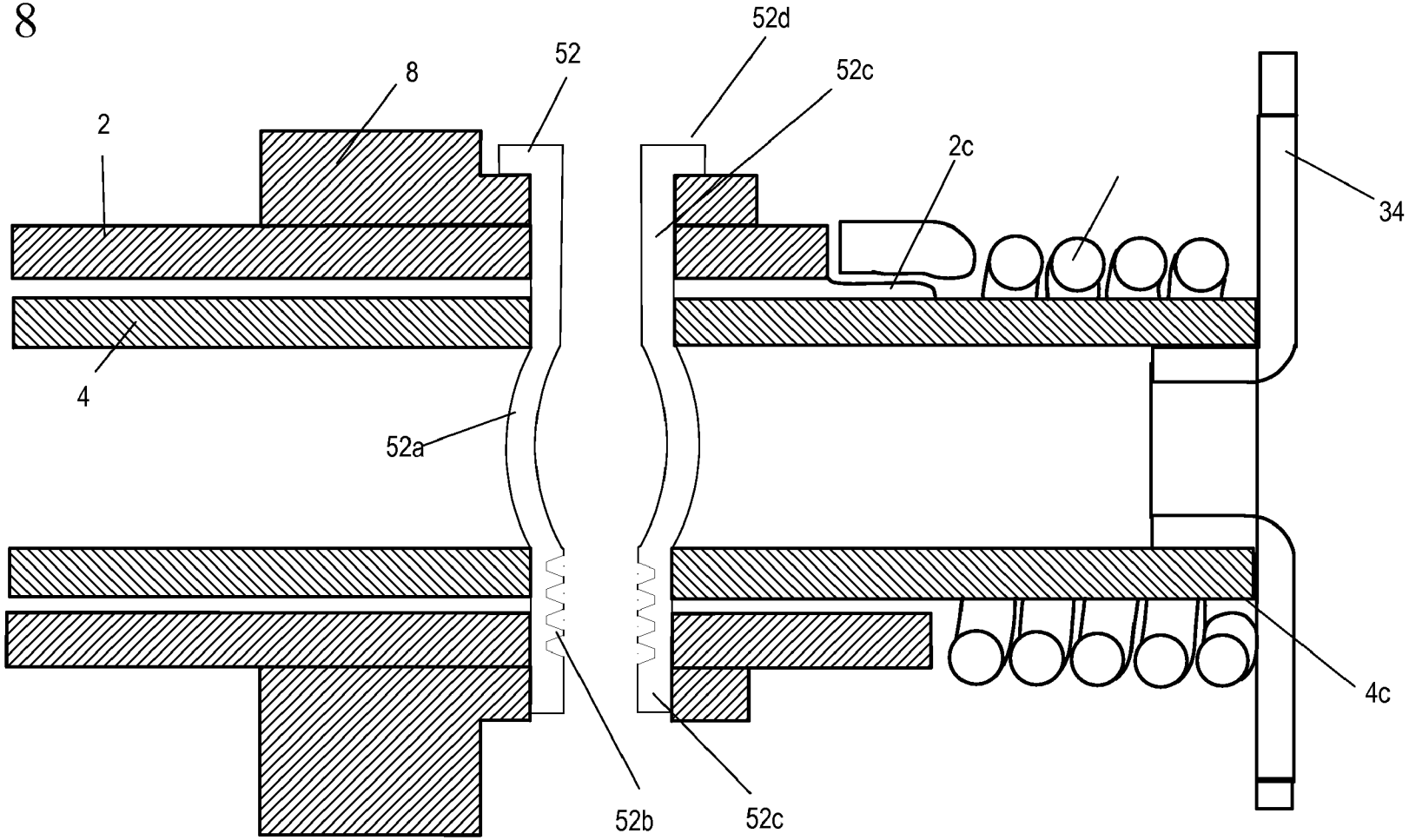
FIG. 8 magnified view of the end of the concentric camshaft with a mechanical connection between the inner shaft and the outer shaft after securing the mechanical connection to the inner shaft of the concentric camshaft.

In a second embodiment, a rivet insert 52 is the mechanical connection used to hold the slip-fit cam lobes or the second set of cams 8 in place on the outer shaft 2, while creating a connection with the inner shaft 4. The rivet insert 52 has a cylindrical hollow body or tube 52*a* with a head 52*d* on a first end. Near the second end, opposite the first end is a threaded portion 52*b*. The threaded portion may be within the hollow body as shown in FIGS. 5-11. During initial assembly, the hollow body 52*a* of the rivet insert 52 is clearance fit to the cam lobe 8, inner shaft 4, and outer shaft 2. The rivet insert 52 is slid through hole 8*a* on the cam lobe flange and passes through the slot 2*a* on the outer shaft 2 and the hole 4*a* in the inner shaft 4 continuing through the axis of rotation to the outer side of the cam lobe 8, until the head 52*d* of the rivet insert 52 contacts and is flush with the cam lobe 8. Once the pin is in position, as shown in FIG. 5, a threaded rod 54 is inserted into the hollow body 52*a* and the threads 54*b* on the outer circumference of the rod 54 engage the threads 52*b* on the hollow body 52*a* of the rivet insert 52. Once the threaded rod 54 properly engages the threads of the rivet insert 52, the threaded rod 54 is pulled out of or away from the rivet insert 52, causing the hollow body 52*a* of the rivet insert 52 present within the hollow inner shaft 4 only to buckle or expand outward, locking the rivet insert in place as shown in FIG. 6. The rivet insert 52 is held rigidly in place while the threaded rod 54 is pulled out or away from the rivet insert by holders 53. The threaded rod 54 is then unthreaded and removed from the rivet insert 52 as shown in FIG. 7. The portion of the hollow insert that extends beyond the inner shaft 4 through the cam lobe 8 is not deformed, so that the rivet insert 52 still has a clearance fit to the outer shaft 2. The clearance fit cam lobes or second cam lobes 8 will float or slide back and forth axially on the portion of the rivet insert 52*c* that is not deformed as shown in FIG. 8.

The rivet insert and the threaded rod may be inserted into the concentric camshaft simultaneously or separately as described above.

Figure 9:
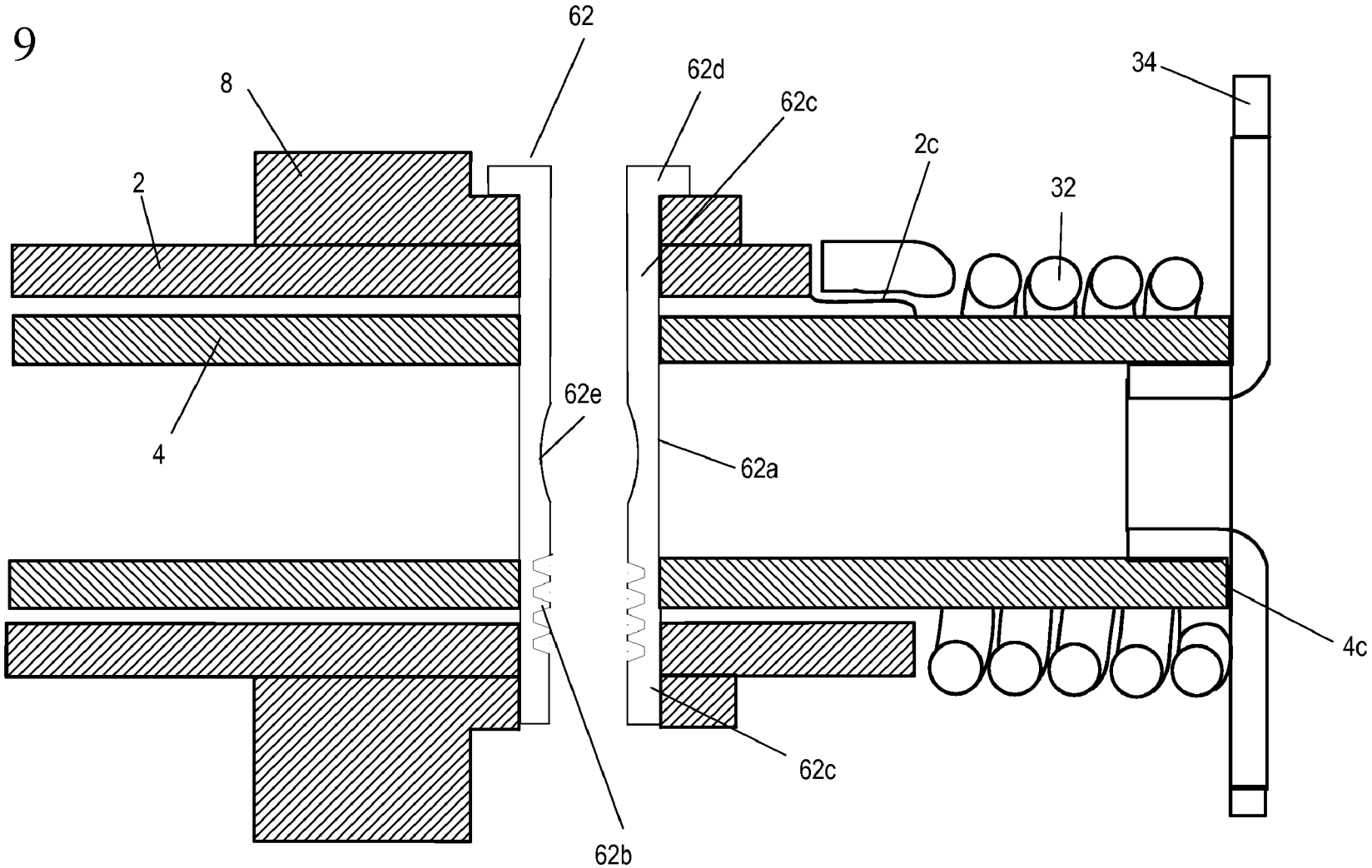
FIG. 9 shows a magnified view of the end of the concentric camshaft with a mechanical connection between the inner shaft and the outer shaft of a third embodiment prior to securing the mechanical connection to the inner shaft of the concentric camshaft.

FIG. 9 shows a mechanical connection of a third embodiment. The rivet insert 62 is used to hold the slip-fit cam lobes or the second set of cams 8 in place on the outer shaft 2, while creating a connection with the inner shaft 4. The rivet insert 62 has a cylindrical hollow body or tube 62*a* with a head 62*d* on a first end. Near the second end, opposite the first end is a threaded portion 62*b*. The threaded portion 62*b* is present within the hollow body 62*a*. Also present within the hollow body 62*a* is a weakened portion 62*e* that is aligned within the hollow of the inner shaft 4. The weakened portion 62*e* may be cuts, slots or any other means of weakening the rivet insert. The rivet insert is assembled as described above in reference to FIGS. 5-8, such that the clearance fit cam lobes or second cam lobes 8 float or slide back and forth axially on the rivet insert portion that is not deformed 62*c*.

Figure 10:
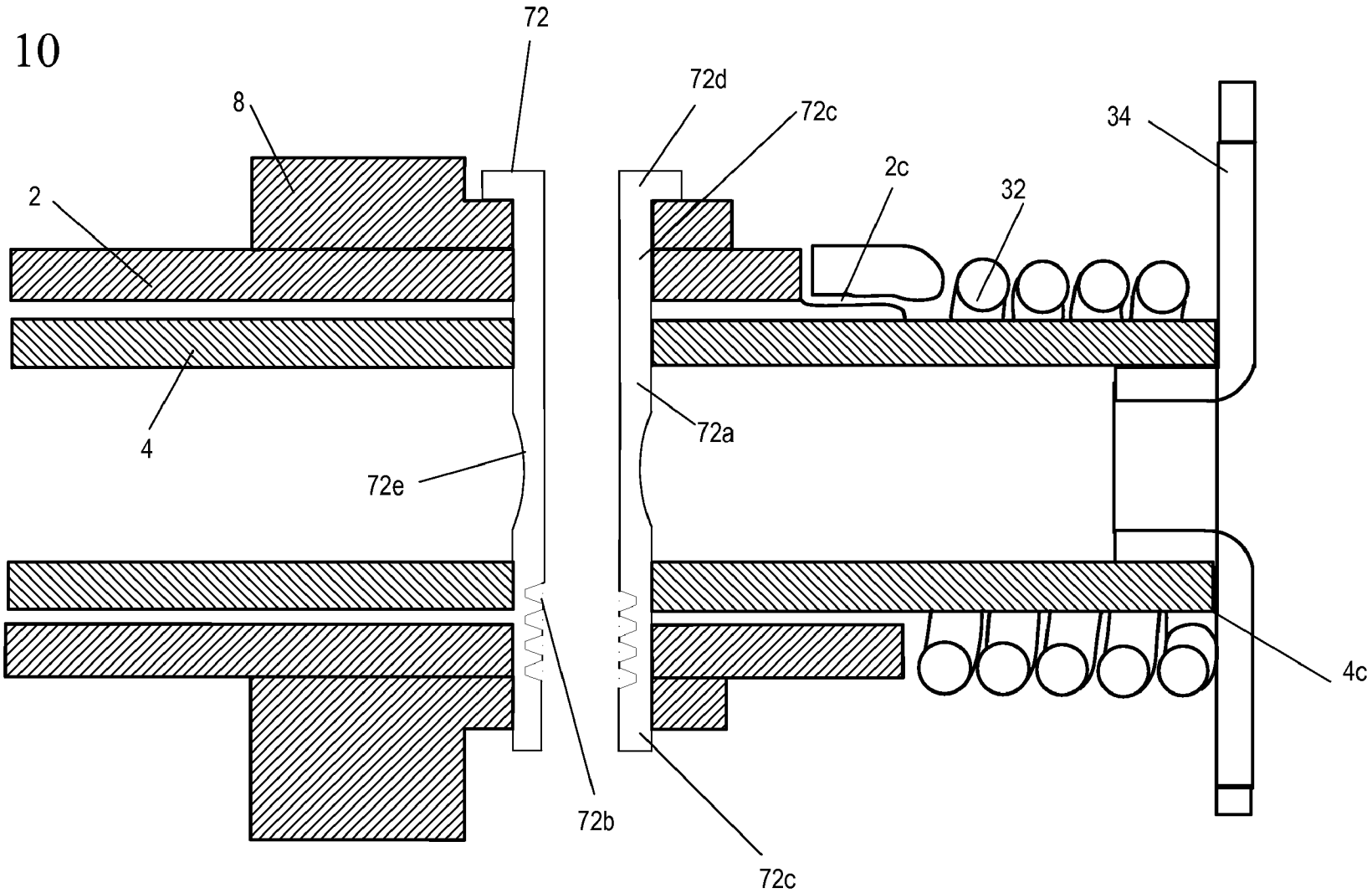
FIG. 10 shows a magnified view of the end of the concentric camshaft with a mechanical connection between the inner shaft and the outer shaft of a fourth embodiment prior to securing the mechanical connection to the inner shaft of the concentric camshaft.

FIG. 10 shows a mechanical connection of a fourth embodiment. The rivet insert 72 is used to hold the slip-fit cam lobes or the second set of cams 8 in place on the outer shaft 2, while creating a connection with the inner shaft 4. The rivet insert 72 has a cylindrical hollow body or tube 72*a* with a head 72*d* on a first end. Near the second end, opposite the first end is a threaded portion 72*b*. The threaded portion is present within the hollow body 72*a*. Present on the outer circumference of the hollow body 62*a* is a weakened portion 72*e* that aligned within the hollow of the inner shaft 4. The weakened portion 72*e* may be cuts, slots or any other means of weakening the rivet insert. The rivet insert is assembled as described above in reference to FIGS. 5-8, such that the clearance fit cam lobes or second cam lobes 8 float or slide back and forth axially on the rivet insert portion that is not deformed 72*c*.

Figure 11:
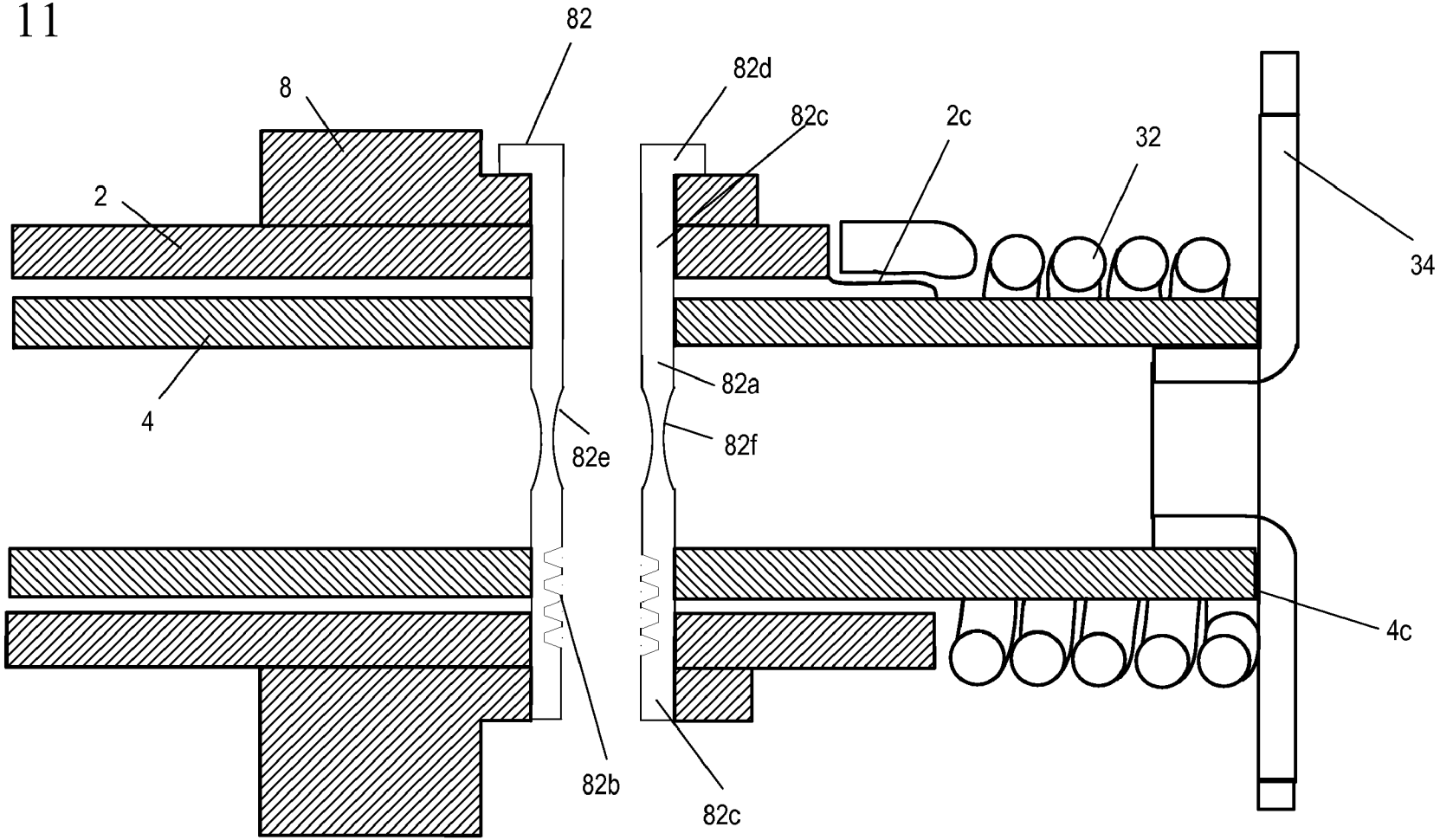
FIG. 11 shows a magnified view of the end of the concentric camshaft with a mechanical connection between the inner shaft and the outer shaft of a fifth embodiment prior to securing the mechanical connection to the inner shaft of the concentric camshaft.

FIG. 11 shows a mechanical connection of a fifth embodiment. The rivet insert 82 is used to hold the slip-fit cam lobes or the second set of cams 8 in place on the outer shaft 2, while creating a connection with the inner shaft 4. The rivet insert 82 has a cylindrical hollow body or tube 82*a* with a head 82*d* on a first end. Near the second end, opposite the first end is a threaded portion 82*b*. The threaded portion 82*b* is present within the hollow body 82*a*. Present within the hollow body 82*a* and on the outer circumference of the hollow body 82*a* are weakened portions 82*e*, 82*f* that is aligned within the hollow of the inner shaft 4. The weakened portions 82*e*, 82*f* may be cuts, slots or any other means of weakening the rivet insert. The rivet insert is assembled as described above in reference to FIGS. 5-7 such that the clearance fit cam lobes or second cam lobes 8 float or slide back and forth axially on the rivet insert portion that is not deformed 82*c*.

The amount of buckling of the portion of the hollow body present in the hollow of the inner shaft is determined by how far the threaded rod is pulled out prior to the rod being removed from the insert.

The phaser 30 attached to the camshaft assembly 40 may be an oil pressure actuated (OPA), torsion assist (TA) as disclosed in U.S. Pat. No. 6,883,481, issued Apr. 26, 2005, entitled "TORSIONAL ASSISTED MULTI-POSITION CAM INDEXER HAVING CONTROLS LOCATED IN ROTOR" with a single check valve TA, and is herein incorporated by reference and/or U.S. Pat. No. 6,763,791, issued Jul. 20, 2004, entitled "CAM PHASER FOR ENGINES HAVING TWO CHECK VALVES IN ROTOR BETWEEN CHAMBERS AND SPOOL VALVE" which discloses two check valve TA, and is herein incorporated by reference, cam torque actuated (CTA) as disclosed in U.S. Pat. No. 5,107,804 issued Apr. 28, 1992, entitled "VARIABLE CAMSHAFT TIMING FOR INTERNAL COMBUSTION ENGINE" and is herein incorporated by reference, or hybrid as disclosed in a patent application Ser. No. 11/286,483 entitled, "CTA PHASER WITH PROPORTIONAL OIL PRESSURE FOR ACTUATION AT ENGINE CONDITION WITH LOW CAM TORSIONALS," filed on Nov. 23, 2005 and hereby incorporated by reference, and a hybrid phaser as disclosed in US patent publication No. 2006-0086332 A1 entitled, "CTA PHASER WITH PROPORTIONAL OIL PRESSURE FOR ACTUATION AT ENGINE CONDITION WITH LOW CAM TORSIONALS," filed on Nov. 23, 2005 and hereby incorporated by reference, although only a cam torque actuated phaser is shown in the drawings.

The phaser 30 adjusts the phase of the shafts 2, 4 relative to each other. The end of the inner shaft 4 of the camshaft assembly 40 has a bore that forms a sleeve for receiving the spool of the control valve 20 of the phaser 30. The inner shaft 4 has annuluses 4*b* that align with the metering slots 20*c* on the spool of the control valve 20. In addition to the annuluses 4*b*, there are several holes in the inner shaft in which fluid passes through the annuluses leading to passages in the rotor 10, allowing oil to pass back and forth to the chambers (not shown). A plug 24 is pressed into the inner shaft 4, which creates a stop for the control valve 20 and captures the control valve spring 23. A through hole 23*a* in the plug 24 is present to allow the back of the control valve 20 to be vented, preventing the valve from being hydraulically locked.

In conventional CTA phasers, two plates are present on the front of the phaser—a center plate and an outer plate. The center plate is used to cover the check valves while the outer plate is used to cover the chambers. By integrating the check valves 21*a*, 21*b* of the CTA phaser into the control valve 20, as disclosed in U.S. Pat. No. 7,000,580, issued Feb. 21, 2006, entitled "CONTROL VALVES WITH INTEGRATED CHECK VALVES" and hereby incorporated by reference, the need for one of these plates has been eliminated and the package size of the rotor is reduced. The control valve 20 also has an additional groove cut 20*d* for an active lock feature as disclosed in U.S. Pat. No. 6,814,038, issued Nov. 9, 2004, entitled, "SPOOL VALVE CONTROLLED VCT LOCKING PIN RELEASE MECHANISM" and hereby incorporated by reference.

Oil for the phaser 30 is directed from a cam bearing 14*b* through a hole 2*b* in the outer shaft 2 to clearance 3 between the inner and outer shafts 4, 2. A seal 36 is placed between the hole 2*b* and the first slot 2*a* in the outer cam 2 to prevent oil from flowing out the back of the camshaft assembly. This directs the oil through the slot 14*c* in the sprocket 14*a* and to an inlet check valve (not shown) in the phaser. To keep the moveable lobes or second set of cams 8 lubricated, oil from another cam bearing 2*d* is directed in between the clearance 3 of the two shafts 2, 4 behind the seal 36. Once between the two shafts 2, 4, the oil is able to flow through the slots 2*a* in the outer shaft 2 and lubricate the moveable lobes or second set of cams 8 as they ride on the outer shaft 2.

At the opposite end of the cam assembly 40 from the phaser 30 is a bias spring or torsion spring 32, in which one end of the spring is attached to the outer shaft 2 through a slot 2*c* and the other end of the spring is attached to the inner shaft 4 through another slot 4*c*.

Alternatively, at the opposite end of the cam assembly 40 from the phaser 30 another bearing may also be present.

Figure 12:
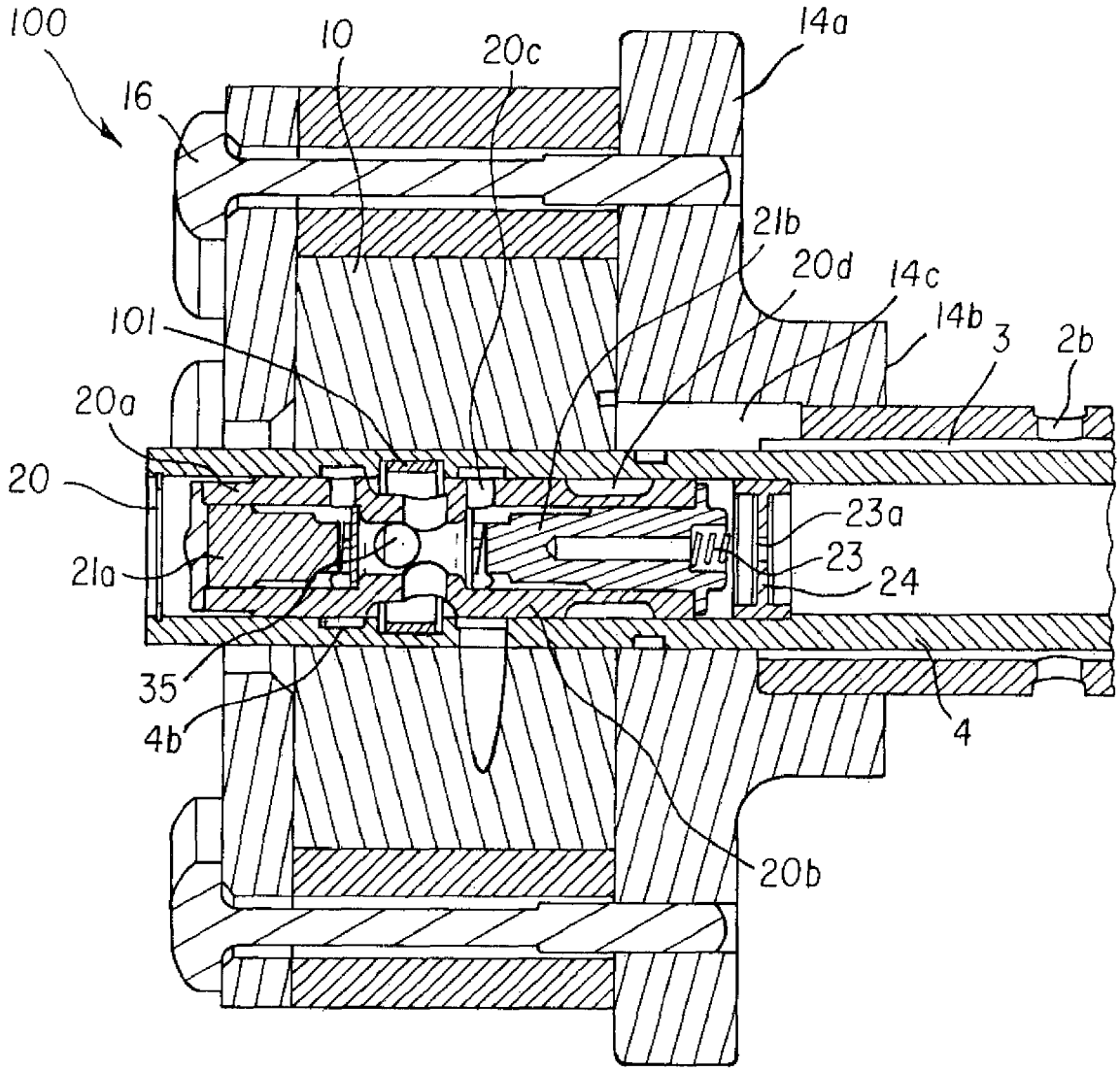
FIG. 12 shows a schematic of a sixth embodiment of the present invention of a cam in cam system with a phaser.

FIG. 12 shows an alternate phaser 100 that may adjust the phase of the shafts 2, 4 relative to each other. The cam in cam system otherwise remains the same as described above in reference to FIGS. 1-2. The mechanical connection between the second set of cam lobes 8 and the outer shaft 2, which are controlled by the inner shaft 4, may be any of the embodiments described above in reference to FIGS. 5-11.

The phaser 100 adjusts the phase of the shafts 2, 4 relative to each other. The end of the inner shaft 4 of the camshaft assembly has a bore that forms a sleeve for receiving the spool of the control valve 20 of the phaser 100. The inner shaft 4 has annuluses 4*b* that align with the metering slots 20*c* on the spool of the control valve 20. In addition to the annuluses 4*b*, there are several holes in the inner shaft in which fluid passes through the annuluses leading to passages in the rotor 10, allowing oil to pass back and forth to the chambers (not shown). In this embodiment, an inlet check valve 101 is present within a central annulus on the inner shaft. The inlet check valve 101 is preferably a band check valve that is pre-tensioned towards the annulus on the inner shaft. A plug 24 is pressed into the inner shaft 4, which creates a stop for the control valve 20 and captures the control valve spring 23. A through hole 23*a* in the plug 24 is present to allow the back of the control valve 20 to be vented, preventing the valve from being hydraulically locked.

In conventional CTA phasers, two plates are present on the front of the phaser—a center plate and an outer plate. The center plate is used to cover the check valves while the outer plate is used to cover the chambers. By integrating the check valves 21*a*, 21*b* of the CTA phaser into the control valve 20, as disclosed in U.S. Pat. No. 7,000,580, issued Feb. 21, 2006, entitled "CONTROL VALVES WITH INTEGRATED CHECK VALVES" and hereby incorporated by reference, the need for one of these plates has been eliminated and the package size of the rotor is reduced. The control valve 20 also has an additional groove cut 20*d* for an active lock feature as disclosed in U.S. Pat. No. 6,814,038, issued Nov. 9, 2004, entitled, "SPOOL VALVE CONTROLLED VCT LOCKING PIN RELEASE MECHANISM" and hereby incorporated by reference.

Oil for the phaser 30 is directed from a cam bearing 14*b* through a hole 2*b* in the outer shaft 2 to clearance 3 between the inner and outer shafts 4, 2. A seal 36 is placed between the hole 2*b* and the first slot 2*a* in the outer cam 2 to prevent oil from flowing out the back of the camshaft assembly. This directs the oil through the slot 14*c* in the sprocket 14*a* and to an inlet check valve 101 in the phaser. As in the first embodiment, although not shown here, to keep the moveable lobes or second set of cams 8 lubricated, oil from another cam bearing 2*d* (not shown) is directed in between the clearance 3 of the two shafts 2, 4 behind the seal 36. Once between the two shafts 2, 4, the oil is able to flow through the slots 2*a* in the outer shaft 2 and lubricate the moveable lobes or second set of cams 8 as they ride on the outer shaft 2.

The phaser 100 attached to the camshaft assembly 40 may be an oil pressure actuated (OPA), torsion assist (TA) as disclosed in U.S. Pat. No. 6,883,481, issued Apr. 26, 2005, entitled "TORSIONAL ASSISTED MULTI-POSITION CAM INDEXER HAVING CONTROLS LOCATED IN ROTOR" with a single check valve TA, and is herein incorporated by reference and/or U.S. Pat. No. 6,763,791, issued Jul. 20, 2004, entitled "CAM PHASER FOR ENGINES HAVING TWO CHECK VALVES IN ROTOR BETWEEN CHAMBERS AND SPOOL VALVE" which discloses two check valve TA, and is herein incorporated by reference, cam torque actuated (CTA) as disclosed in U.S. Pat. No. 5,107,804 issued Apr. 28, 1992, entitled "VARIABLE CAMSHAFT TIMING FOR INTERNAL COMBUSTION ENGINE" and is herein incorporated by reference, or hybrid as disclosed in a patent application Ser. No. 11/286,483 entitled, "CTA PHASER WITH PROPORTIONAL OIL PRESSURE FOR ACTUATION AT ENGINE CONDITION WITH LOW CAM TORSIONALS," filed on Nov. 23, 2005 and hereby incorporated by reference, and a hybrid phaser as disclosed in US patent publication No. 2006-0086332 A1 entitled, "CTA PHASER WITH PROPORTIONAL OIL PRESSURE FOR ACTUATION AT ENGINE CONDITION WITH LOW CAM TORSIONALS," filed on Nov. 23, 2005 and hereby incorporated by reference, although only a cam torque actuated phaser is shown in the drawings.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of assembling a camshaft assembly for an internal combustion engine having the steps of placing an inner shaft having holes within a hollow outer shaft having slots; such that the slots on the outer shaft are aligned with the holes on the inner shaft, fixing a first set of cam lobes to the outer shaft and placing a second set of cam lobes with a clearance fit over slots on the outer shaft; and mounting a variable cam timing (VCT) device to the inner shaft and the outer shaft of the camshaft, such that the position of the inner shaft is adjustable relative to the outer shaft, further comprising the steps of:

a) inserting hollow pins into a hole defined by the second set of cam lobes, through the slot in the outer shaft and the hole in the inner shaft, continuing through the axis of rotation to an other side of the second set of cam lobes; and b) inserting a plug into a first end of the hollow pin; and c) introducing fluid under pressure into the hollow pins through a second end of the hollow pin, opposite the first end by which centers of the hollow pins are swelled within an inner diameter of the inner shaft.

2. A method of assembling a camshaft assembly for an internal combustion engine having the steps of placing an inner shaft having holes within a hollow outer shaft having slots; such that the slots on the outer shaft are aligned with the holes on the inner shaft, fixing a first set of cam lobes to the outer shaft and placing a second set of cam lobes with a clearance fit over slots on the outer shaft; and mounting a variable cam timing (VCT) device to the inner shaft and the outer shaft of the camshaft, such that the position of the inner shaft is adjustable relative to the outer shaft, further comprising the steps of:

a) inserting a rivet insert into a hole defined by the second set of cam lobes, through the slot in the outer shaft and the hole in the inner shaft continuing through the axis of rotation to an other side of the second set of cam lobes, the rivet insert having a hollow cylindrical body with a first end and a second end, with a threaded portion present within the second end of the hollow cylindrical body;

b) inserting a threaded rod into the rivet insert to engage the threaded portion present on the second end of the hollow cylindrical body of the threaded insert;

c) pulling the threaded rod away from the second end of the rivet insert, such that the portion of the hollow cylindrical body within the inner shaft buckles, expanding outward; and d) removing the threaded rod from rivet insert.

3. The method of claim 2 wherein the steps of a) and b) are combined into one step.

4. The method of claim 2, wherein a portion of the hollow cylindrical body of the rivet insert has a weakened portion.

5. The method of claim 2, wherein portions of the rivet insert extending beyond the inner shaft and through the second set of cam lobes are deformed to maintain a clearance fit to the outer shaft and the second set of cam lobes.

6. A camshaft assembly for an internal combustion engine comprising:

a hollow outer shaft with slots along a length of the shaft;

an inner shaft comprising a bore at an end of the inner shaft and holes along a length of the inner shaft; the inner shaft received within the hollow outer shaft, such that the holes along the length of the inner shaft are aligned with the slots along the length of the outer shaft;

a first set of cam lobes fixed to the outer shaft;

a second set of cam lobes defining a hole, placed on the outer shaft such that the hole is aligned over the slots on the outer shaft with a clearance fit;

a means for fixing the second set of cam lobes to the inner shaft, while simultaneously allowing the second set of cam lobes to be a clearance fit to the outer shaft; and a phaser comprising:

a housing with an outer circumference for accepting drive force coupled to the outer shaft;

a rotor coaxially located within the housing and fixedly attached to the end of the inner shaft of the camshaft assembly, the housing and the rotor defining at least one vane separating a chamber in the housing, the vane being capable of rotation to shift the relative angular position of the housing and the rotor; and a control valve received by the bore at the end of the inner shaft for directing fluid to the chambers.

7. The camshaft assembly of claim 6, wherein the means for fixing the second set of cam lobes to the inner shaft is a hollow shaft received by the hole defined by the second set of cam lobes, the slot in the outer shaft, and the hole in the inner shaft, continuing through the axis of rotation to an other side of the second set of cam lobes.

8. The camshaft assembly of claim 7, wherein a portion of the shaft aligned with the inner shaft is expanded, locking a central portion of the shaft to the inner shaft such that remaining portions of the shaft extending beyond the inner shaft and through the second set of cam lobes remain to be a clearance fit to the outer shaft and the second set of cam lobes.

9. The camshaft assembly of claim 7, wherein the shaft is a hollow pin.

10. The camshaft assembly of claim 8, wherein the central portion of the hollow shaft is locked to the inner shaft by introducing fluid under pressure into the hollow shaft, swelling the central portion of the hollow shaft.

11. The camshaft assembly of claim 7, wherein the shaft is a rivet insert having a hollow cylindrical body with a first end and a second end, with a threaded portion present within the second end of the hollow cylindrical body.

12. The camshaft assembly of claim 11, wherein the portion of the rivet insert aligned with the inner shaft is expanded by inserting a threaded rod to engage the threaded portion on the second end of the rivet insert, pulling the threaded rod away from the second end of the insert such that a portion of the cylindrical body with in the inner shaft buckles, expanding outward, and removing the threaded rod from the insert.

13. The camshaft assembly of claim 6, wherein the phaser is cam torque actuated, oil pressure actuated, or torsion assist.

14. The camshaft assembly of claim 6, wherein the control valve comprises a spool with a plurality of lands.

15. The camshaft assembly of claim 6, wherein the bore at the end of the inner shaft forms a sleeve around the control valve.

16. The camshaft assembly of claim 6, further comprising an actuator for positioning the control valve.

17. The camshaft assembly of claim 6, further comprising an inlet check valve in an annulus on an inner surface of the bore at the end of the inner shaft.

18. The camshaft assembly of claim 14, wherein the inlet check valve is a band check valve and pre-tensioned towards the annulus on the inner shaft.

* * * * *